US006752582B2

(12) United States Patent
Garcia

(10) Patent No.: US 6,752,582 B2
(45) Date of Patent: Jun. 22, 2004

(54) SAFETY CONE PLACING DEVICE AND METHOD

(75) Inventor: Guadalupe C. Garcia, Modesto, CA (US)

(73) Assignee: Worldwide Safety, LLC, Sacramento, CA (US)

( * ) Notice: Subject to any disclaimer, the term of this patent is extended or adjusted under 35 U.S.C. 154(b) by 32 days.

(21) Appl. No.: 10/194,709

(22) Filed: Jul. 12, 2002

(65) Prior Publication Data

US 2003/0210975 A1 Nov. 13, 2003

Related U.S. Application Data

(60) Provisional application No. 60/378,874, filed on May 7, 2002.

(51) Int. Cl.[7] ..... E01F 9/014; E01F 9/017

(52) U.S. Cl. ..... 414/467; 221/185; 116/63 C; 414/507

(58) Field of Search ..... 221/185; 414/467, 414/507; 116/63 C

(56) References Cited

U.S. PATENT DOCUMENTS

| | | | | |
|---|---|---|---|---|
| 2,333,273 A | | 11/1943 | Scanlon | 40/125 |
| 3,750,900 A | | 8/1973 | Piercey | 214/6 |
| 4,197,807 A | * | 4/1980 | Campbell | 116/63 P |
| 4,219,141 A | * | 8/1980 | Lovy | 224/273 |
| 4,597,706 A | | 7/1986 | Michit | 414/30 |
| 4,967,930 A | | 11/1990 | Koltze | 221/222 |
| 5,054,648 A | | 10/1991 | Luoma | 221/185 |
| 5,213,464 A | | 5/1993 | Nicholson et al. | 414/440 |
| 5,244,334 A | | 9/1993 | Akita et al. | 414/502 |
| 5,488,792 A | * | 2/1996 | Kwok | 40/612 |
| 5,525,021 A | | 6/1996 | Larguier | 414/551 |
| 6,053,657 A | | 4/2000 | Signorelli | 404/6 |
| 6,056,498 A | | 5/2000 | Velinsky et al. | 414/555 |
| 6,435,369 B1 | | 8/2002 | Poursayadi | 221/185 |
| 6,556,147 B1 | * | 4/2003 | Fisher et al. | 340/908 |

FOREIGN PATENT DOCUMENTS

| | | | |
|---|---|---|---|
| EP | 421 198 | * | 9/1990 |
| FR | 2672319 | * | 8/1992 |

* cited by examiner

*Primary Examiner*—Steven A. Bratlie
(74) *Attorney, Agent, or Firm*—Lumen Intellectual Property Services, Inc.

(57) ABSTRACT

Automatic delivery and placement of safety cones from a moving vehicle is provided. The key idea is that there is a receptacle that holds a plurality of safety cones. The receptacle is attached to the vehicle. A releasing means which is attached to the receptacle is controlled and advances the safety cones in an automatic and controlled fashion, one-by-one, to different locations on a road, street, freeway, intersection, or the like. The advantage is that it automatically takes care of the placement of a plurality of safety cones. There would no longer be a need for a person to manually deliver and place the safety cones. Therefore, the present invention provides for increased safety since it decreases or even eliminates the number of fatal or non-fatal accidents as well as chronic injuries of road-workers that are involved in placing safety cones.

57 Claims, 11 Drawing Sheets

SAFETY CONE PLACING DEVICE AND METHOD

CROSS-REFERENCE TO RELATED APPLICATIONS

This application is cross-referenced to and claims priority from U.S. Provisional Application 60/378,874 filed on May 7, 2002, which is hereby incorporated by reference. This application is also cross-referenced to U.S. patent application Ser. No. 10/131,316 filed on Apr. 23, 2002.

FIELD OF THE INVENTION

The present invention relates generally to traffic marker devices or safety cones used to alert or divert vehicles, watercrafts, aircrafts and pedestrians to pass safely around hazards, obstacles or other areas. More particularly, the present invention relates to a device and method for automatically placing safety cones to areas where it is necessary to alert or divert vehicles, watercrafts, aircrafts or pedestrians.

BACKGROUND

Traffic or safety cones are routinely used to direct motorists and pedestrians away from obstacles or dangerous areas. Safety cones are usually brightly colored, hollow conical shaped devices made of a synthetic, rubber or other plastic (See for example U.S. Pat. No. 2,333,273 to Scanlon et al.). Commonly, safety cones are placed by an individual who is manually delivering and/or placing these cones to a particular place on, for instance, but not limited to, a freeway, a road, a street, an intersection, or the like. In other cases, a vehicle can take an individual to a particular place, however it is still the individual that needs to place the safety cones by hand once the vehicle has arrived at that particular place. This task is labor-intensive, slow and could easily result in chronic back-injuries in those individuals who perform such a task routinely. Automation of this task would be preferred. However, with the current safety cones, being fairly rigid and having a tendency to easily fall over, delivering the cones in an automatic fashion from a moving vehicle would not be practical. The reason that this would not be practical is due to the chance for the current relatively rigid safety cones to remain upright upon placement would not be that high when they are delivered and placed from a moving vehicle. Furthermore, if such an automation would take place with the current fairly rigid safety cones, and since some or most of these cones would not able to maintain their upright position, the fallen cones need to be re-placed to their upright position by an individual so that these cones can be useful to the public as safety cones. Therefore, there is first a strong need for improved safety cones or marker devices. Second there is a strong need for an apparatus and method to automatically deliver and place such improved safety cones.

SUMMARY OF THE INVENTION

The present invention provides a device, method and system for automatically delivering and placing a safety cone to a position on a ground surface from a moving vehicle. The key idea of the present invention is that there is a receptacle that holds a plurality of safety cones. A releasing means which is attached to the receptacle is controlled and advances the safety cones in an automatic and controlled fashion, one-by-one, to different locations on a road, street, freeway, intersection, or the like.

The device of the present invention includes a receptacle for holding a plurality of safety cones. The preferred selection of safety cones that could be used in the present invention is a safety cone that includes a flexible means positioned over a base and wherein the bottom of the flexible means is attached to the base. The device further includes a releasing means for releasing one out of the plurality of safety cones to a position on a ground surface. The releasing means advances one safety cone to a position on the ground, while it prevents the remainder of the plurality of safety cones from being released from the receptacle. In order to control the timing of each release the device of the present invention also includes a control means to control the releasing means.

The method of the present invention for automatically placing a safety cone includes the step of providing a receptacle for holding a plurality of safety cones. The method further includes the step of providing a releasing means for releasing one out of the plurality of safety cones, one at a time, from the receptacle to a position on a ground surface, while preventing the remainder of the plurality of safety cones from being released from the receptacle. A control means is provided to control said release of each safety cone.

The system of the present invention for automatically delivering and placing safety cones from a moving vehicle includes a receptacle for holding a plurality of safety cones, whereby the receptacle is attached to the moving vehicle. The system further includes a releasing means for releasing one out of the plurality of safety cones, one at a time, to a position on a ground surface. During the release the releasing means prevents the remainder of the plurality of safety cones from being released from the receptacle. The system further includes a control means to control the releasing means and placement of the plurality of safety cones at different positions on the ground surface.

In view of that which is stated above, it is the objective of the present invention to automatically place safety cones to a ground surface.

It is still another objective of the present invention to automatically deliver safety cones to a ground surface from a moving vehicle.

It is still another objective of the present invention to provide a receptacle attached to a vehicle for holding a plurality of safety cones that could be placed on a ground surface.

It is still another objective of the present invention to provide a releasing means for releasing means for releasing the safety cones on-by-one to different position on a ground surface.

It is yet another objective of the present invention to provide a control means to control the timing of the release of the safety cones.

It is yet another objective of the present invention to provide one or more sensors to further automate the delivery and placement of safety cones.

It is yet another objective of the present invention to use safety cones which each include a flexible cone part that is placed over a base and whereby the bottom part of the flexible cone part is attached to the base.

The advantage of the present invention is that it automatically takes care of the placement of a plurality of safety cones. There would no longer be a need for a person to manually deliver and place the safety cones. Human interaction would only be required to initiate and stop the release of one or more safety cones. The present invention therefore provides for increased safety. The present invention would decrease or even eliminate the number of fatal or non-fatal accidents as well as chronic injuries of road-workers that are involved in placing safety cones. Furthermore, the time it takes to deliver and place the safety cones will be significantly decreased compared to manual placement. It also allows the driver of the vehicle delivering the safety cones to no longer worry about the cone placement and could therefore pay more attention to the accident or event that initiated the safety cone placement.

BRIEF DESCRIPTION OF THE FIGURES

The objectives and advantages of the present invention will be understood by reading the following detailed description in conjunction with the drawings, in which.

DETAILED DESCRIPTION OF THE INVENTION

Although the following detailed description contains many specifics for the purposes of illustration, anyone of ordinary skill in the art will readily appreciate that many variations and alterations to the following exemplary details are within the scope of the invention. Accordingly, the following preferred embodiment of the invention is set forth without any loss of generality to, and without imposing limitations upon, the claimed invention.

The present invention provides a device, method and system for automatically delivering and placing a safety cone to a position on a ground surface. The key idea of the present invention is that there is a receptacle that holds a plurality of safety cones. A releasing means which is attached to the receptacle is controlled and advances the safety cones in an automatic and controlled fashion, one-by-one, to different locations on a road, street, freeway, intersection, or the like. The present invention provides for increased safety. The present invention would decrease or even eliminate the number of fatal or non-fatal accidents as well as chronic injuries of road-workers that are involved in placing safety cones.

Figure 1:
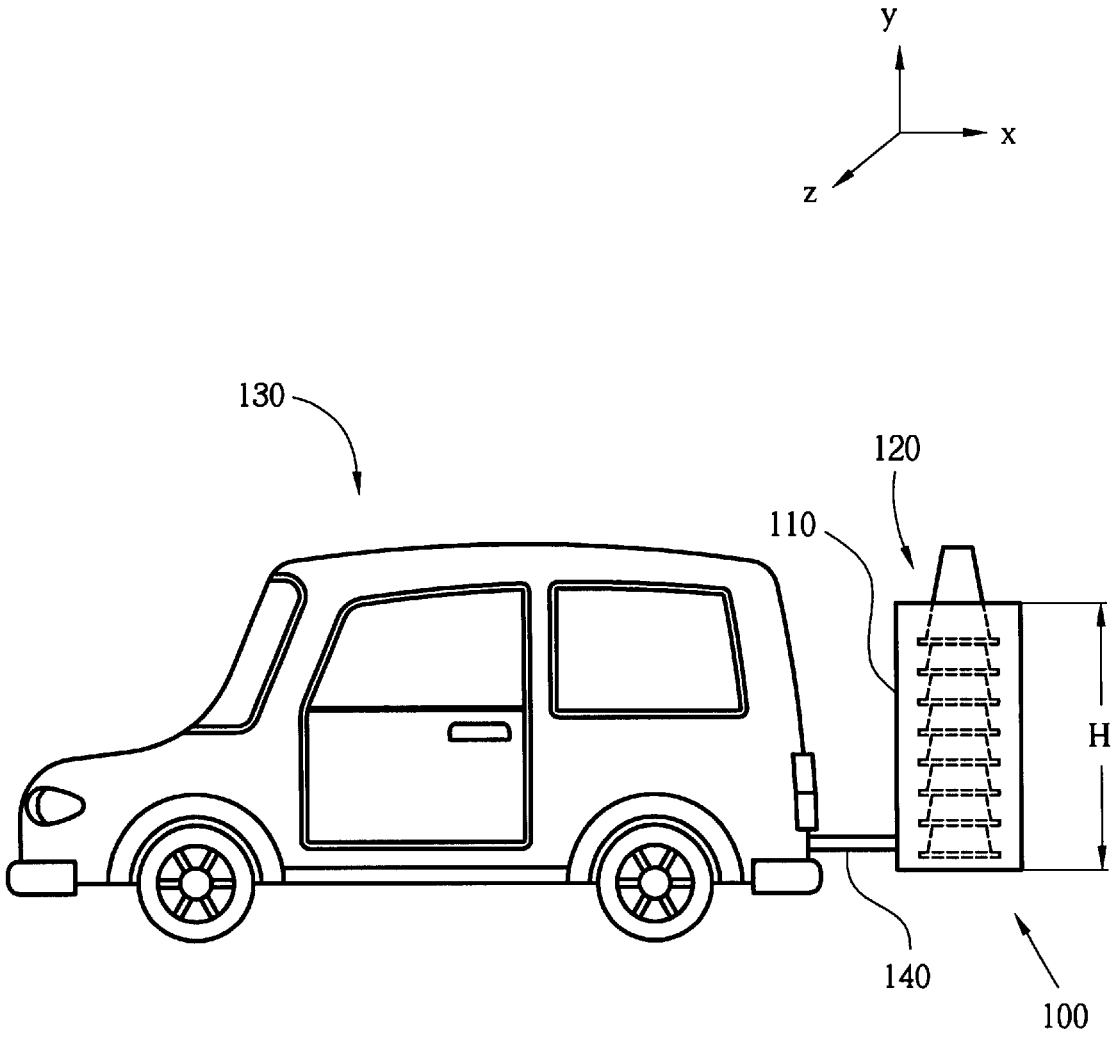
FIG. 1 shows an exemplary embodiment of a device attached to a vehicle according to the present invention.

FIG. 1 shows a device 100 that includes a receptacle 110 for holding a plurality of safety cones 120. Device 100 is attached to a vehicle 130 that is carrying device 100. Device 100 could be attached to any location of vehicle 130. However, the preferred location of attaching device 100 to vehicle 130 is somewhere at the back or near the back of vehicle 130. The ultimate location for device 100 is dependent on the type of vehicle and/or the type of service the vehicle is intended to provide. It could, for instance, be possible that the best location for device 100 is at one of the sites of vehicle 130. Device 100 could be attached to vehicle 130 with any type of connecting or attaching means 140 that provides a rigid, movable, adjustable and/or pivotal connection or attachment. As a person of average skill in the art would readily appreciate, connecting or attaching means 140 could further include means (not shown), such as a linear or rotary motor, to translate and/or rotate device 100 around its X-, Y-, and Z-axes to establish the proper position of device 100 relative to vehicle 130.

Figure 2:
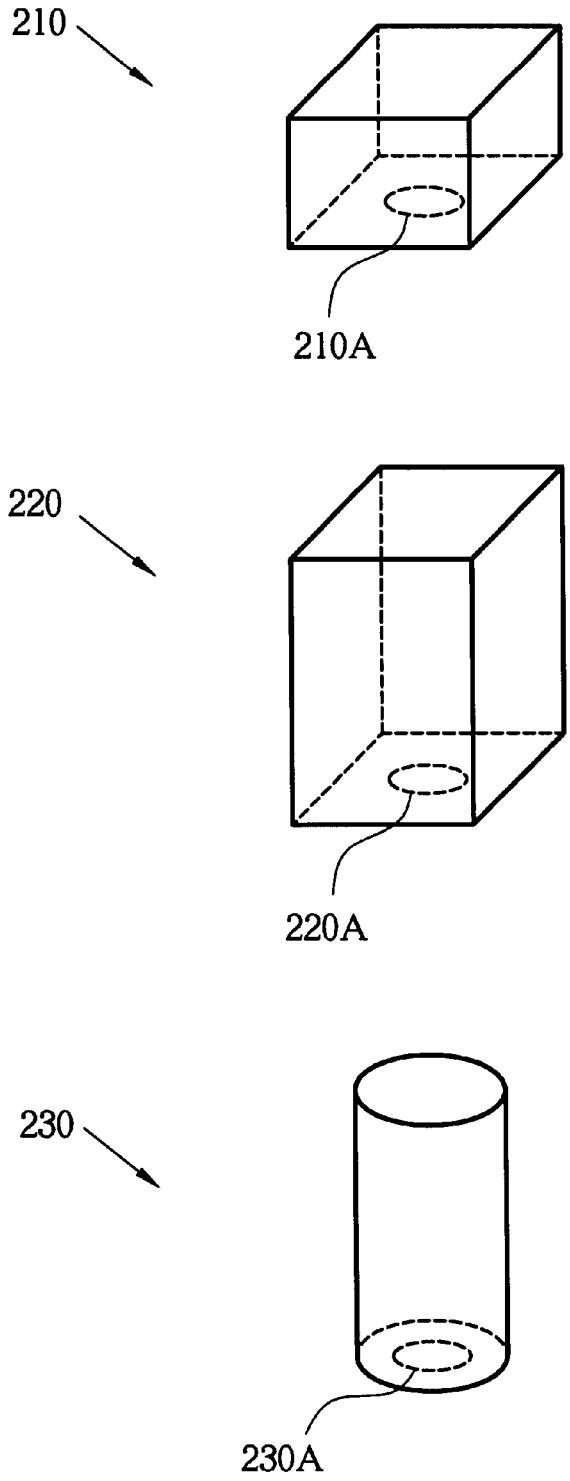
FIG. 2 shows exemplary embodiments of a receptacle according to the present invention.

Receptacle 110 could take any type of shape, such as, but not limited to, a square 210, rectangular 220, cylindrical 230 or the like as show in FIG. 2. Furthermore, receptacle 110 could be an enclosed structure or a wire frame structure as long as the plurality of safety cones can be held inside receptacle 110 without falling out receptacle 110 or tipping over. The requirement for receptacle 110 is that it needs to allow a user to place a plurality of safety cones inside receptacle 110. Another requirement for receptacle 110 is that it has an opening 210A, 220A or 230A or a mechanism (not shown) to create an opening through which the safety cone, that is about to be released and placed to a position on a surface, could pass. Opening 210A, 220A or 230A is preferably situated at the bottom of receptacle 110. Yet another requirement for receptacle 110 is that it has enough height H so that it could host enough safety cones that are adequate for the intended activities or events without the safety cones tipping over or falling out of receptacle 110. Safety cones 120 are preferably stacked inside receptacle 110.

The receptacle further includes a releasing means for releasing one out of the plurality of safety cones at a time to a position on a ground surface, while the releasing means prevents the remainder of the plurality of safety cones from being released from the receptacle. As a person of average skill might readily appreciate, releasing means could therefore also be referred to as a holding and releasing means. In general, the receptacle includes one or more elements that are movably attached to the receptacle to release one out of the plurality of safety cones. The same one or more elements could also be used to prevent the remainder safety cones from being released from the receptacle. However, as a person of average skill in the art would readily appreciate, the receptacle could also have one or more elements specifically designed for releasing the safety cone, whereas other one or more elements could be specifically designed for holding the remainder safety cones in the receptacle. The one or more elements could move back-and-forth between a holding position to hold the plurality of safety cones and a releasing position to release the one out of the plurality of safety cones while preventing the remainder of safety cones from being released from said receptacle. The one or more elements could also be arranged in a pattern (such as a propeller-shape) whereby the elements are attached to a common structure. It is then the common structure that is movably attached to the receptacle.

Figure 3:
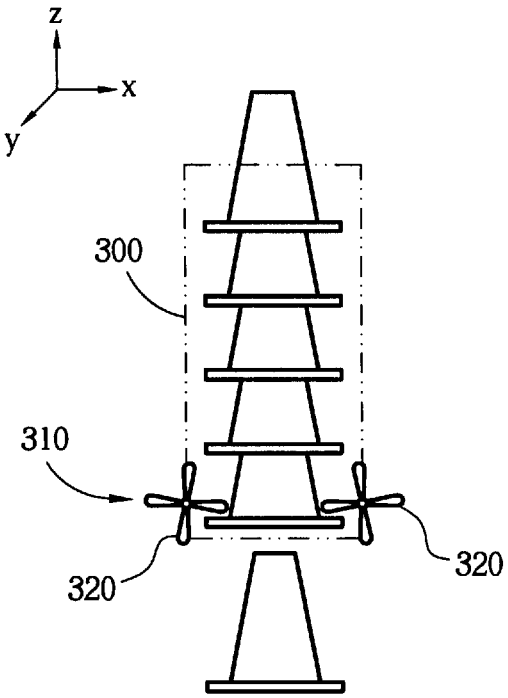
FIGS. 3–5 show exemplary embodiments a releasing means according to the present invention.
Figure 4:
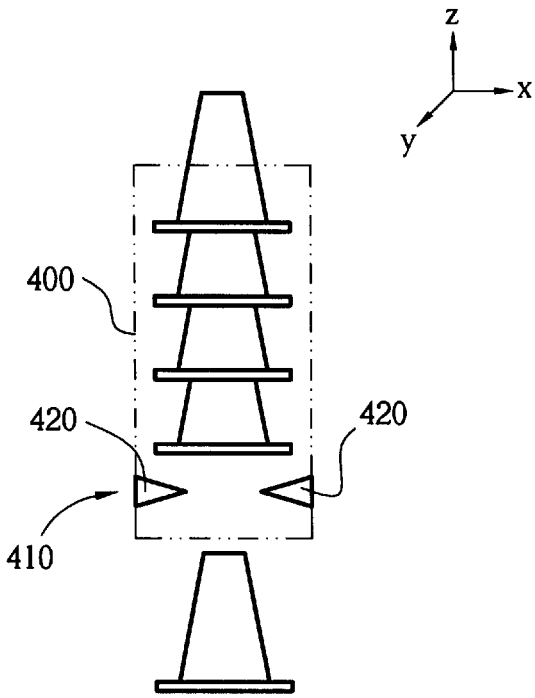
Figure 5:
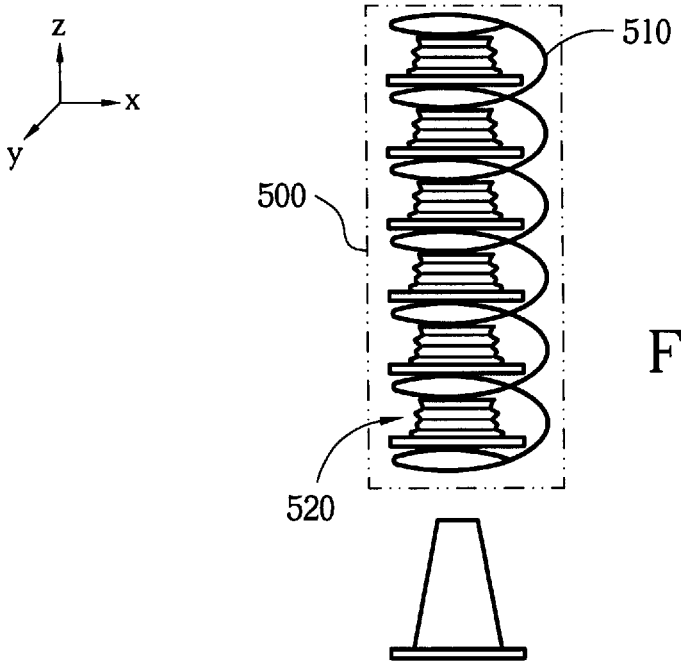

FIGS. 3–5 show exemplary receptacles 300, 400 and 500 respectively, including exemplary releasing means 310, 410 and 510 respectively, that are capable of holding a plurality of safety cones and capable of releasing the safety cones, one at a time. Releasing means 310, 410 and 510 are attached to receptacle 300, 400 and 500, respectively as shown by exemplary embodiments in FIGS. 3–5. Releasing means is preferably attached near the bottom part of delivering device. The key idea of releasing means is that once releasing means advances, it releases a safety cone, the remaining safety cones in the delivering device then advance downward until it is their turn to be released. As a skilled artisan in the art to which this invention pertains would readily appreciate, several different releasing means could be used and the present invention is in no way limited to the particular embodiments 310, 410 and 510 as they are described below with reference to FIGS. 3–5.

FIG. 3 shows receptacle 300 with releasing means 310. Releasing means 310 includes one or two "propeller-like" devices 320 that rotate around the Y-axis. If two "propeller-like" devices 320 are used then both "propeller-like" devices 320 are aligned as shown in FIG. 3 and advance in the same manner as a person of average skill in the art would readily appreciate. The exemplary embodiment shown in FIG. 3 is not limited to one or two "propeller-like" devices 320, since it could also be possible to have a plurality of "propeller-like" devices 320 distributed over the bottom or the vertical length of delivering device 300. In this example of FIG. 3, the propeller-like device could be seen as one or more elements, in this case four, that are attached to a common structure. The common structure is then movably attached to receptacle 300.

FIG. 4 shows receptacle 400 with releasing means 410. Releasing means 410 includes one or two elements 420 that could either rotate downward around the Y-axis, translate in-and-out along the X-axis, rotate around the Z-axis, or a combination of translation(s) and/or rotation(s) around the different axes. If two elements 420 are used then both elements 420 are aligned as shown in FIG. 4 and operate similar, as a person of average skill in the art would readily appreciate. Elements 420 are not limited to a particular shape and could for instance have a triangular shape, square shape, flat shape or round shape. The exemplary embodiment of FIG. 4 is also not limited to one or two elements 420, since it could also be possible to have a plurality of elements 420 distributed over the vertical length of delivering device 400.

FIG. 5 shows receptacle 500 with releasing means 510. Releasing means 510 includes a spiral element that could rotate around the Z-axis. The idea here is that the safety cones are placed in spiral element, preferably in a collapsed position 520. The safety cones will be released once the spiral rotates. Releasing means 510 advances a safety cone, as one of average skill in the art would readily appreciate. Once the safety cone is released or being released, the safety cone expands from its collapsed position.

Figure 6:
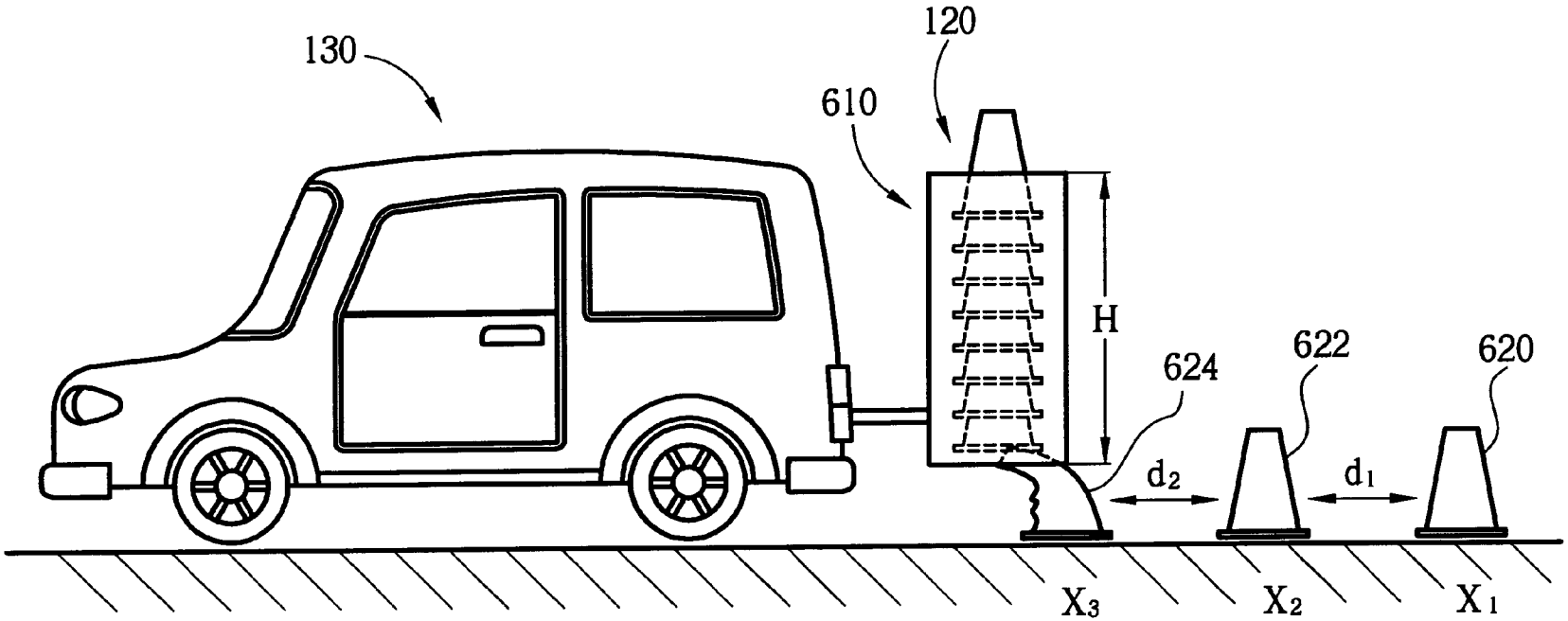
FIG. 6 shows an example of delivering and placing safety cones according to the present invention.

As shown in FIG. 6, receptacle 610 places one safety cone at the time to a particular place. For instance, safety cone 620 was released and delivered at place $X_1$ at time $T_1$, safety cone 622 was released and delivered at place $X_2$ at time $T_2$, and safety cone 624 is being released and delivered at place $X_3$ at time $T_3$. As a person of average skill would readily appreciate, device 610 could place one or more safety cones as many as there are hosted in receptacle 610. As will be discussed below in more detail, the present invention would preferably require the use of safety cones that have a flexible cone part that could be easily bend or undergo perturbations during the placement of the safety cones without jeopardizing a correct, upright placement of the safety cones as is shown in FIG. 6. In this case, the height of device 610 with respect to the ground would then not really matter. Important to note is that the weight of the bottom part or base of the safety cone ensures the safety cone to move downwards when it is released and the flexible to part would automatically follow the position of the base of the safety cone. Once the base is placed on the ground and the flexible top part leaves receptacle 610, then the flexible top part flops up to its upright position.

Figure 7:
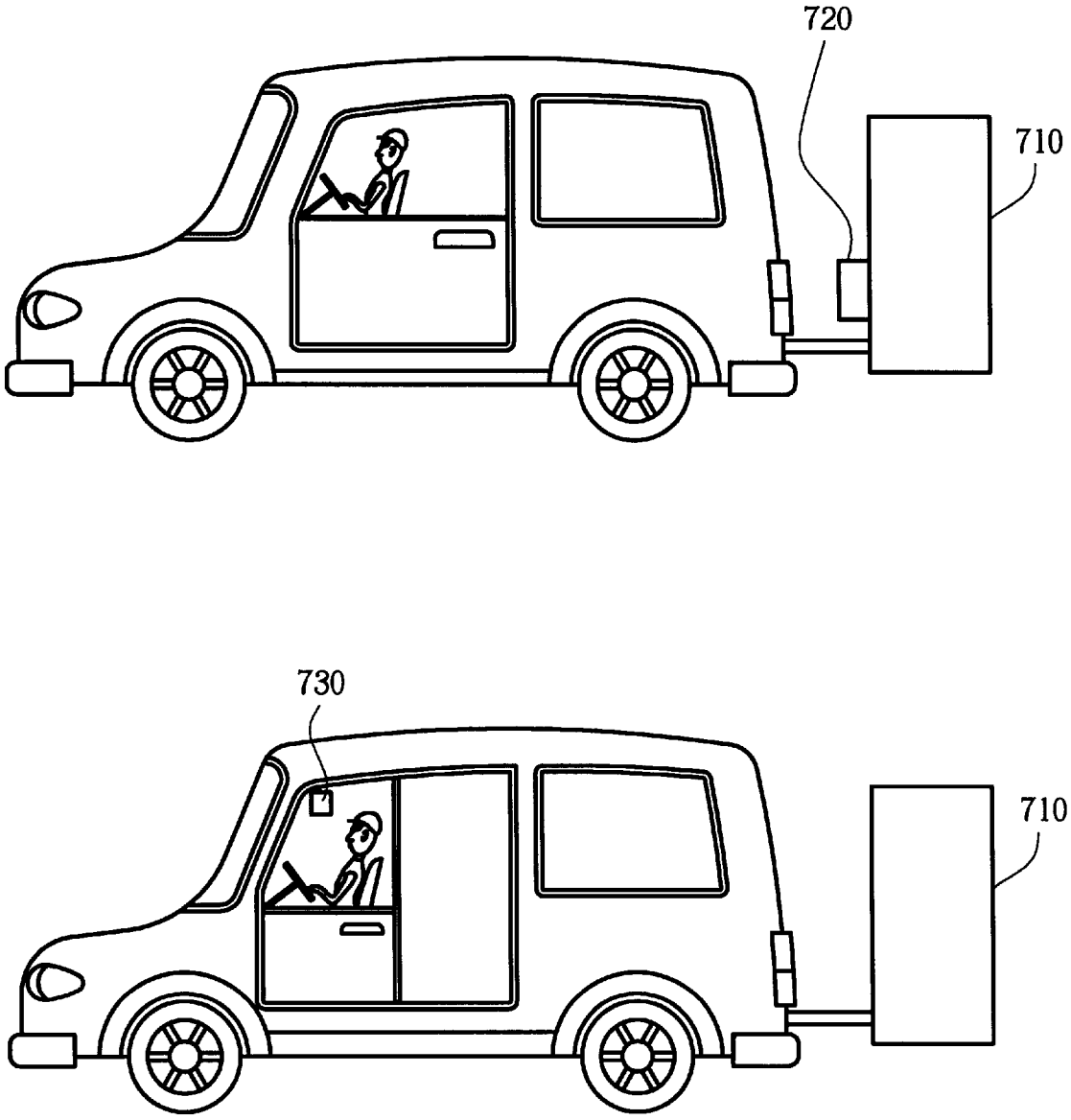
FIG. 7 shows exemplary embodiments of a control means according to the present invention.

In order to release a safety cone, a control means 720 is included to receptacle 710 to control the releasing means as shown in FIG. 7. Control means 720 controls the timing of the release of one out of the plurality of safety cones. Control means 720 is not limited to controlling the timing of one safety cone, since it could easily control the timing of two or more safety cones. In case a plurality of safety cones would need to be placed, then control means 720 could control the release of the safety cones, one-by-one, so that they are placed at equal distance, variable distance from each other, or a combination of equal or different distances.

Figure 8:
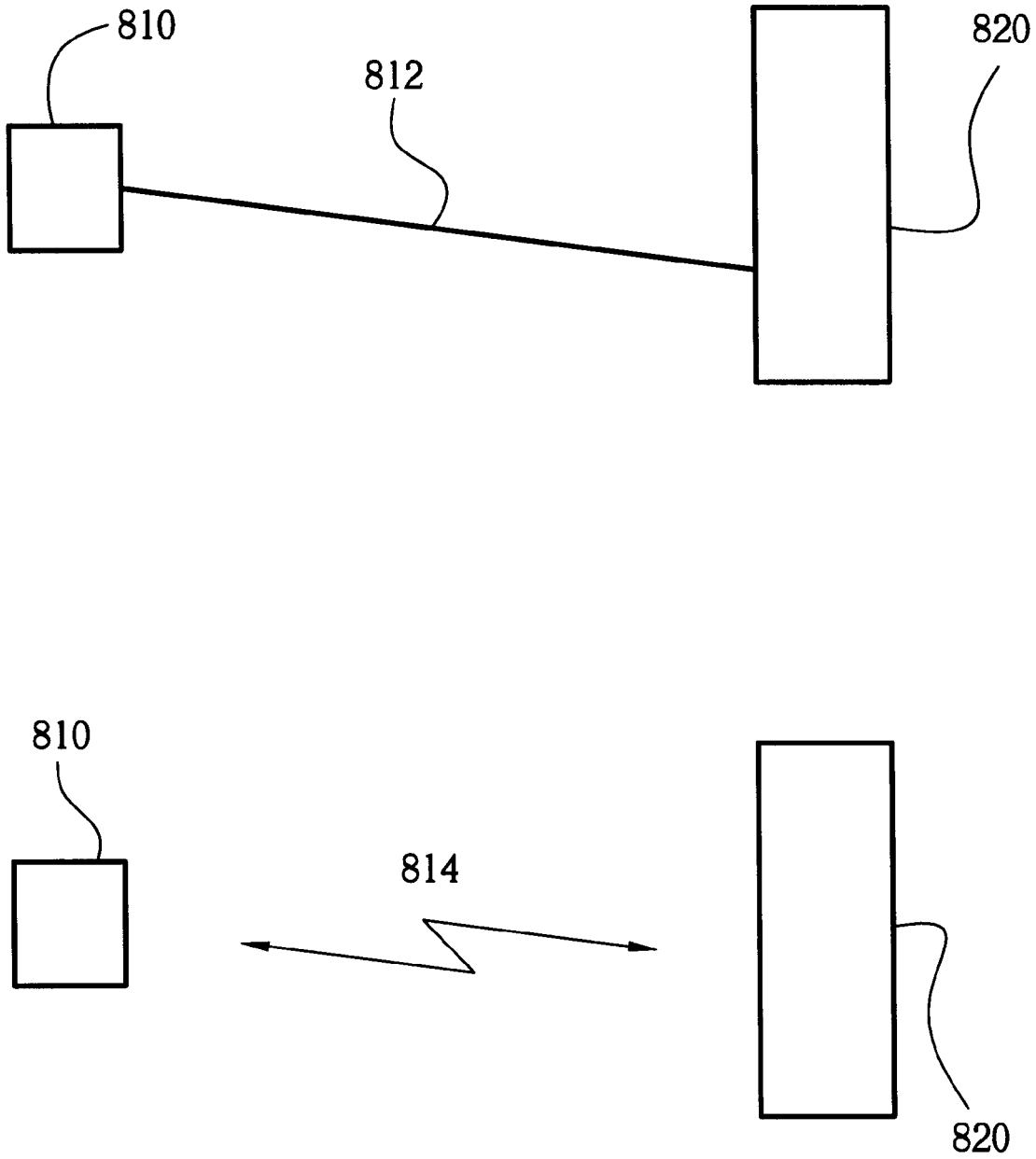
FIG. 8 shows exemplary communication means between the control means and the releasing means according to the present invention.

As shown in FIG. 7, device 710 includes a control means 720 to control the operation of device 710 to release a safety cone, one at the time. Control means 720 could be in close proximity to device 710 or integrated with device 710, however the present invention is in no way limited to the position of control means 720 relative to device 710 as long as control means 720 could be controlled or operated by a user, as one of average skill in the art would readily appreciate. However, having control means is close proximity to the driver of the vehicle would be preferred as it is shown by control means 730, so that the driver can continue to drive the car and/or focus on the situation or accident that initiates the placement of safety cones, while releasing safety cones. Control means 810 communicates with device 820 either via an electrical wire connection 812 or via a wireless connection 814 as shown in FIG. 8.

Figure 9:
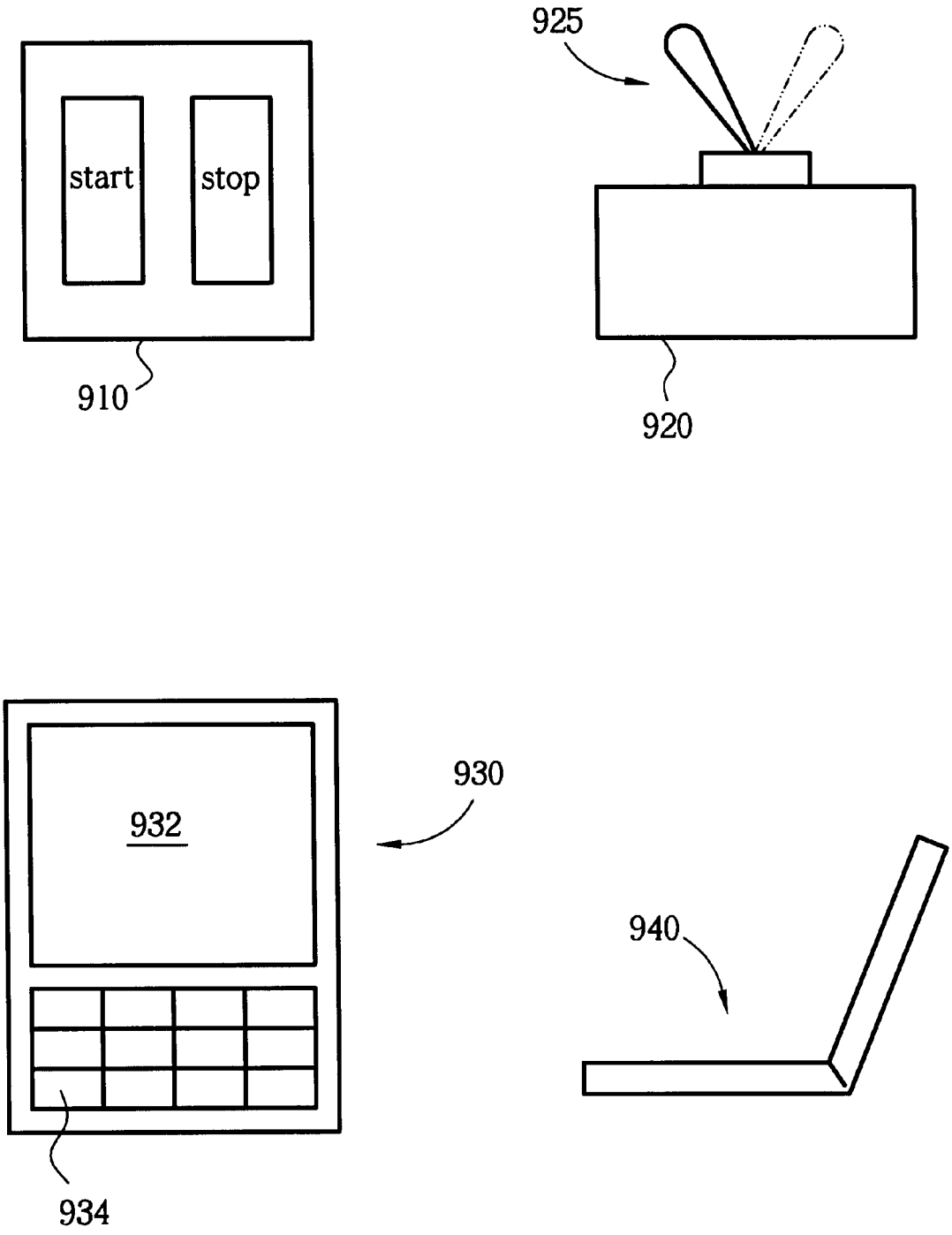
FIG. 9 shows exemplary embodiments of different control means according to the present invention.

As shown in FIG. 9, control means could include a small touch screen/panel 910 with a start and stop button, a switch box 920 with one or more switches 925, or the like, to control a release of one or more safety cones. However, control means of the present invention is not limited to touch screen/panel 910 or a switch box 920, since it could also be a personal digital assistant 930 with a touch-screen or display 932 and a keyboard 934, or other computer device such as, but not limited to, a laptop 940 to communicate with the releasing means. Furthermore, control means could also receive voice commands (not shown), which are then interpreted by the control means and communicated to the releasing means. The basic parameters to be controlled by the control means are the start and stop of the release of a single safety cone or a plurality of safety cones in continuity. However, as one of average skill in the art would readily appreciate, the control means could be more sophisticated in that it could automatically control the timing of subsequent safety cones once the start signal has been provided. For instance, one or more sensors that could provide, for instance, distance information to the control means could be used to sense the distance traveled by the vehicle and then after the vehicle travels a certain distance, the next safety cone could be released. In the example of a more sophisticated control, the control means then only triggers the start of the release of the first safety cone and then the subsequent release of one or more safety cones follows automatically in a controlled fashion with the cones being released and placed at a preferred distance from each other (see for instance $X_1$ and $X_2$ in FIG. 6). The distance can, for instance, be programmed or preset in the control means, since it could be easily gathered or calculated by the control means, given the feedback or sensory information over the distance, time and/or speed that the vehicle has traveled, as one of average skill in the art would readily appreciate. Another example is that control means could include one or more schedules to schedule the release and delivery that could either be programmed or entered for a particular event. In other words, a user could either manually control the start and stop by manually control the delivering device, or could control the start and stop of an automatic release schedule, whereby the automatic release schedule includes a small control program using sensory or feedback information as input and signals to control means as output. As one of average skill in the art would readily appreciate, such an automation would be desirable and preferred, since a person driving the vehicle would no longer have to worry about the correct placement of the safety cones and whether or not they are falling over or not. Furthermore, such an automated delivery schedule would be much faster than current procedures of manually delivering the safety cones. It would be more efficient, faster and also reduces or even eliminates the physical stress on individuals who used to be reseponsible for placing the safety cones manually. The present invention could also include sensors that check or verify whether a safety cone is actually released and placed correctly. Examples of such sensors are, for instance, different types of optical sensors.

Figure 10:
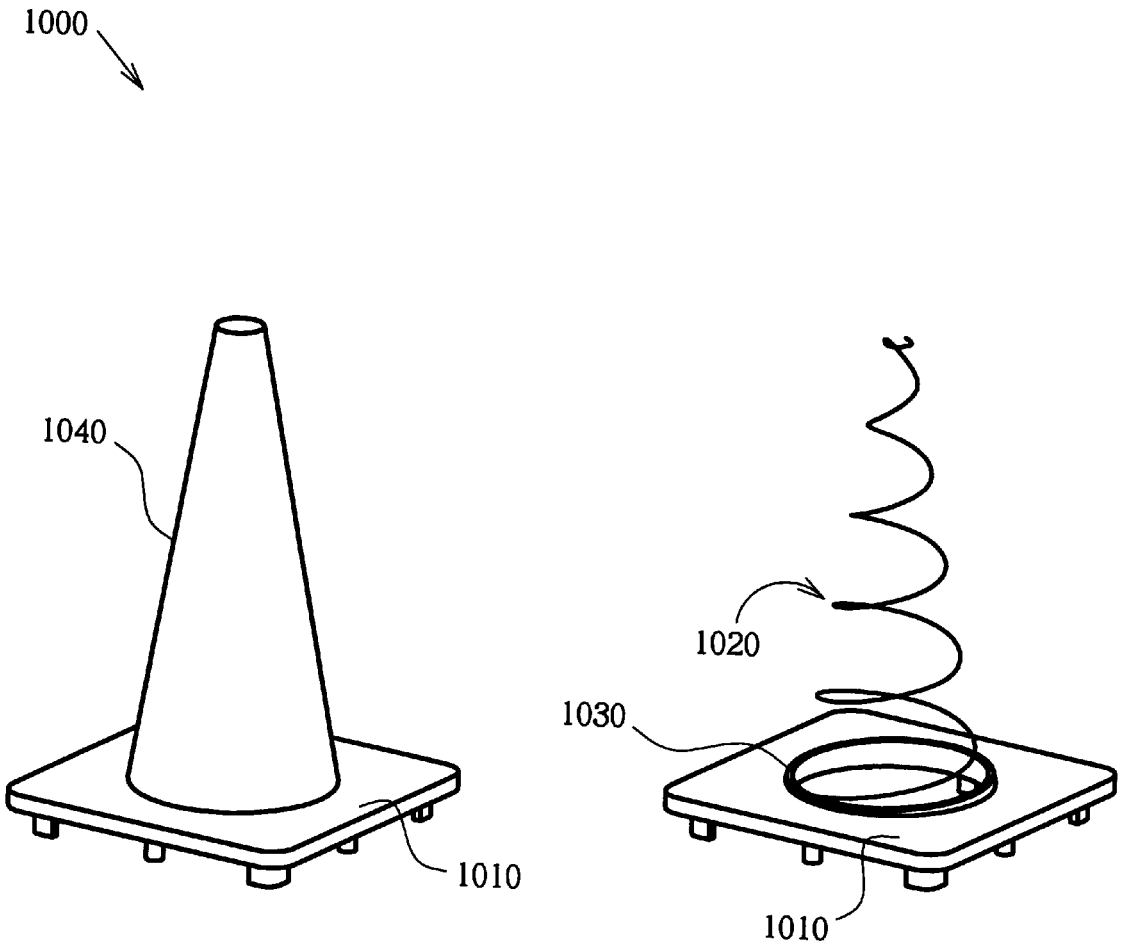
FIG. 10 shows a preferred safety cone with a flexible means according to the present invention.
Figure 11:
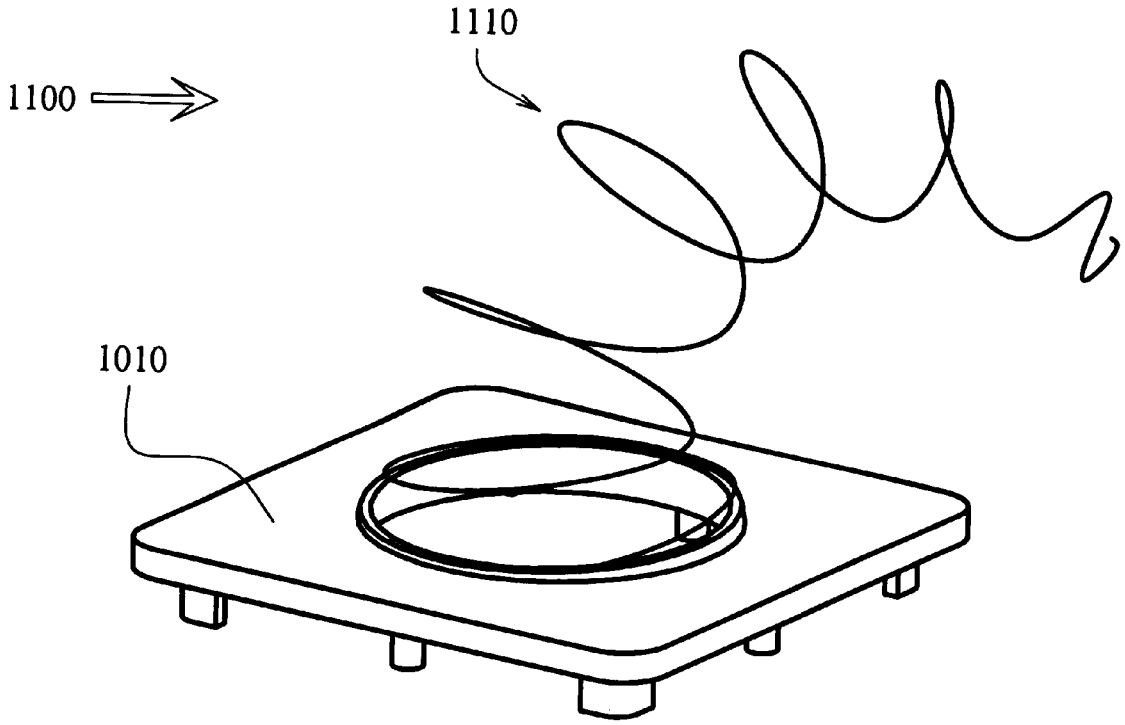
FIGS. 11–12 show the safety cone of FIG. 10 deviated from its original position due to a perturbation according to the present invention.
Figure 12:
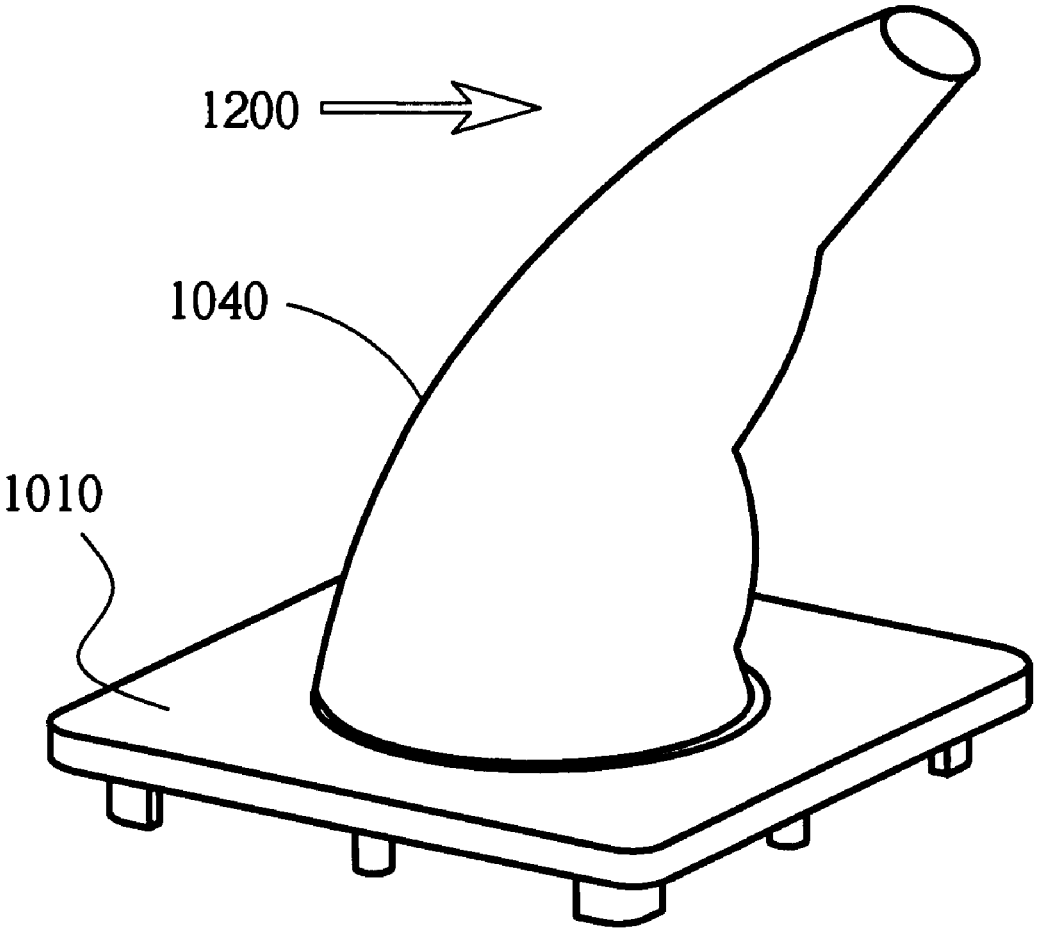

The type of safety cone to be used in combination with the device of the present invention is a safety cone that would stay upright upon release from the receptacle. Furthermore, as mentioned above, the present invention would also require the use of safety cones that could be easily bend, or undergo perturbations during the placement of the safety cones without jeopardizing a correct, upright placement of the safety cones as is illustrated in FIG. 6. FIGS. 10–12 show preferred embodiments of a safety cone that would be preferred in combination with the device of the present invention (The reader is referred to U.S. patent application Ser. No. 10/131,316 filed on Apr. 23, 2002 for more details regarding these flexible safety cones; U.S. patent application Ser. No. 10/131,316 is incorporated for all that it discloses). However, as a person of average skill in the art would readily appreciate, the present invention is not limited to this particular safety cone as long as it could be easily released to an upright and stable position without tipping or falling over upon release from the receptacle.

Figure 13:
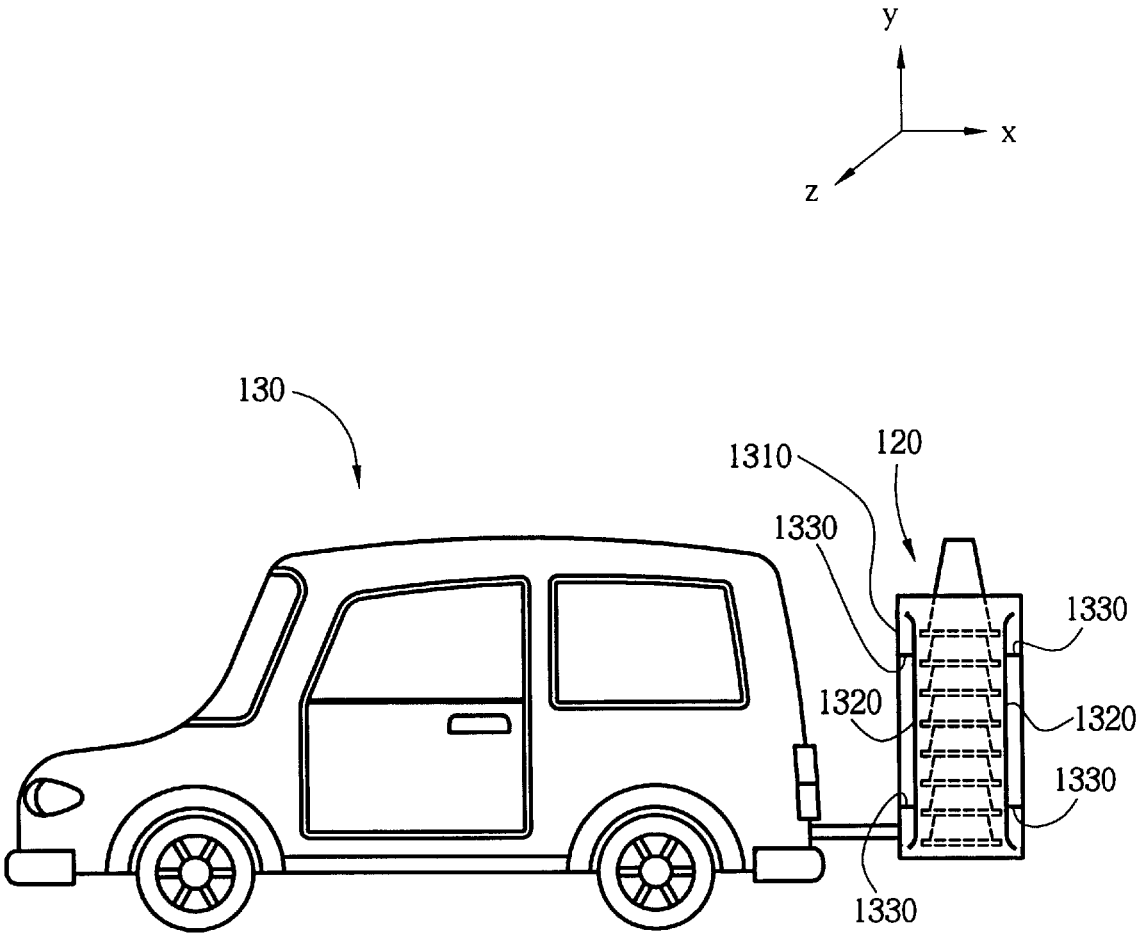
FIG. 13 shows a receptacle including a guiding means to guide the safety cones according to the present invention.

As shown in FIG. 10, safety cone 1000 of includes a base 1010 and a flexible means 1020 that is positioned over base 1010. The bottom part 1030 of flexible means 1020 is attached to base 1010. As a person of average skill in the art would readily appreciate, different means and ways could be employed to attach or combine flexible means 1020 and base 1010. Flexible means 1020 is, for instance, but not limited to, a coil and maintains in an original upright position in absence of a natural or traffic perturbation as shown in FIG. 10. However, flexible means 1110 deviates from this original position in presence of a natural or traffic perturbation 1100 and 1200 as shown in FIGS. 12 and 13, respectively, or a perturbation from being released from a receptacle or being placed to a ground surface from a moving vehicle as shown in FIG. 6. Moreover, the flexible means restores from this deviated position back to the original position after the perturbation disappears or is removed as it is taught in the pending application. Furthermore, the safety cone includes a cover 1040 to cover flexible means 1020 and 1110 as shown in FIGS. 10–11, respectively. The advantage of the safety cone over previous rigid safety cones is that the flexible safety cone can more easily resist various types of perturbations without falling over due to its flexible design. Therefore these safety cone would be an excellent candidate and preferred safety cone or marker device that could be used for automatically placing safety cones from a moving vehicle at a particular place on the road, freeway or any other area, since the chances of falling over are significantly reduced or minimized.

The present invention has now been described in accordance with several exemplary embodiments, which are intended to be illustrative in all aspects, rather than restrictive. Thus, the present invention is capable of many variations in detailed implementation, which may be derived from the description contained herein by a person of ordinary skill in the art. For instance, as it has been taught in U.S. patent application Ser. No. 10/131,316 filed on Apr. 23, 2002, the safety cones could also include a light source that could be automatically activated upon release and placement to a position on a ground surface. Another variation is shown in FIG. 13 whereby receptacle 1310 further includes a guiding means to guide the safety cones within receptacle 1310. Guiding means could, for instance, include one or more surfaces 1320 whereby each of the surfaces 1320 are movably connected to receptacle 1310 by, for instance, spring loaded mechanisms 1330. The key idea is that the guiding means guides the safety cones in a position so that the safety cones maintain upright and are nicely guided downward every time a safety cones is released. As a person of average skill in the art would readily appreciate, a variety of mechanisms could be employed to movably connect surfaces 1320 and the present invention is not limited to spring loaded mechanisms 1330. Furthermore, the present invention is also not limited to surfaces 1320 as shown in FIG. 13 since it would also be possible to have a guiding means as a bar positioned through the center of the safety cones (not shown). All such variations are considered to be within the scope and spirit of the present invention as defined by the following claims and their legal equivalents.

What is claimed is:

1. A safety cone placing device, comprising:

(a) a receptacle attached to a vehicle for holding a plurality of safety cones;

(b) a releasing means coupled to said receptacle for releasing one of said plurality of safety cones from said receptacle directly to a position on a ground surface and for preventing the remainder of said plurality of safety cones from being released from said receptacle, wherein each of said plurality of safety cones is capable of undergoing perturbations during said releasing and of staying upright and stable upon release from said receptacle; and (c) a control means coupled said releasing means for controlling said releasing means such that said plurality of safety cones are released and placed at different positions on said ground surface while said vehicle moves.

2. The device as set forth in claim 1, wherein said releasing means is attached near the bottom part of said receptacle.

3. The device as set forth in claim 1, wherein said releasing means comprises one or more elements movably attached to said receptacle to release said one of said plurality of safety cones.

4. The device as set forth in claim 1, wherein said releasing means comprises one or more elements movably attached to said receptacle to prevent said remainder safety cones from being released from said receptacle.

5. The device as set forth in claim 1, wherein said releasing means comprises one or more elements movably attached to said receptacle to release said one of said plurality of safety cones and prevent said remainder safety cones from being released from said receptacle.

6. The device as set forth in claim 1, wherein said releasing means comprises one or more elements movably attached to said receptacle to move back-and-forth between a holding position to hold said plurality of safety cones and a releasing position to release said one of said plurality of safety cones while preventing the remainder of safety cones from being released from said receptacle.

7. The device as set forth in claim 1, wherein said releasing means is an advancing system to advance said one of said plurality of safety cones while preventing the remainder of safety cones from being released from said receptacle.

8. The device as set forth in claim 1, wherein said releasing means comprises one or more elements wherein said one or more elements are arranged in a pattern and attached to a common structure, wherein said common structure is movably attached to said receptacle.

9. The device as set forth in claim 1, wherein said releasing means comprises one or more elements and wherein said one or more elements comprises propeller-like elements.

10. The device as set forth in claim 1, wherein said releasing means comprises a spiral element capable of holding said plurality of safety cones, and capable of releasing said one of said plurality of safety cones when said spiral element advances rotationally around its longitudinal axis.

11. The device as set forth in claim 1, wherein said control means controls the timing of said release of said one of said plurality of safety cones.

12. The device as set forth in claim 1, wherein said control means controls the timing between the release of two or more safety cones from said plurality of safety cones, wherein said two or more safety cones are released sequentially and placed at different positions on said ground surface.

13. The device as set forth in claim 1, wherein said control means comprises one or more sensors to provide feedback to said control means, wherein said sensors provide information regarding speed of said vehicle, distance traveled by said vehicle, said time lapsed between safety cone releases, or correct placement or release of said safety cone.

14. The device as set forth in claim 1, wherein said control means comprises means to determine when to release the next safety cone.

15. The device as set forth in claim 1, wherein said control means comprises a voice recognition system to receive voice commands from a user and said one or more voice commands control said releasing means.

16. The device as set forth in claim 1, wherein said control means comprises a touch-panel to allow a user to enter one or more commands to control said releasing means.

17. The device as set forth in claim 1, wherein said control means comprises one or more switches or buttons to allow a user to control said releasing means.

18. The device as set forth in claim 1, wherein said control means comprises a programmable user interface to program one or more control parameters that control said releasing means.

19. The device as set forth in claim 1, wherein said control means comprises one or more schedules to schedule the release of said safety cones.

20. The device as set forth in claim 1, wherein said control means comprises a wireless communication to communicate with said releasing means.

21. The device as set forth in claim 1, wherein each of said plurality of safety cones comprises a flexible cone part positioned over a base wherein the bottom of said flexible cone part is attached to said base.

22. The device as set forth in claim 1, wherein each of said plurality of safety cones comprises a flexible means positioned over a base wherein the bottom of said flexible means is attached to said base.

23. The device as set forth in claim 1, wherein each of said plurality of safety cones comprises a flexible means positioned over a base, wherein the bottom of said flexible means is attached to said base, and wherein said flexible means comprises a light source that could be activated upon release and placement of said one of plurality of safety cones to a position on a ground surface.

24. The device as set forth in claim 1, wherein said plurality of safety cones are stacked on top of each other.

25. The device as set forth in claim 1, wherein said receptacle comprises an opening through which said one of said plurality of safety cones is released.

26. The device as set forth in claim 1, wherein said receptacle comprises an opening means to create an opening through which said one of said plurality of safety cones could be released.

27. The device as set forth in claim 1, wherein said receptacle comprises guiding means to guide said plurality of safety cones.

28. A method for automatically placing one or more safety cones, comprising the steps of:

(a) utilizing a plurality of safety cones each of which is capable of undergoing natural and traffic perturbations and of staying upright and stable in absence of said perturbations;

(b) attaching a receptacle to a vehicle for holding said plurality of safety cones;

(c) releasing one of said plurality of safety cones from said receptacle directly to a position on a ground surface via a releasing means, said releasing means preventing the remainder of said plurality of safety cones from being released from said receptacle; and (d) controlling, via a control means, said releasing means such that said plurality of safety cones are released and placed at different positions on said ground surface while said vehicle moves.

29. The method as set forth in claim 28, wherein said releasing step occurs when said vehicle is moving.

30. The method as set forth in claim 28, further comprising the step of attaching said releasing means near the bottom part of said receptacle.

31. The method as set forth in claim 28, wherein said releasing means comprises one or more elements movably attached to said receptacle to release said one of said plurality of safety cones.

32. The method as set forth in claim 28, wherein said releasing means comprises one or more elements movably attached to said receptacle to prevent said remainder safety cones from being released from said receptacle.

33. The method as set forth in claim 28, wherein said releasing means comprises one or more elements movably attached to said receptacle to release said one of said plurality of safety cones and prevent said remainder safety cones from being released from said receptacle.

34. The method as set forth in claim 28, where in said releasing means comprises one or more elements movably attached to said receptacle to move back-and-forth between a holding position to hold said plurality of safety cones and a releasing position to release said one of said plurality of safety cones while preventing the remainder of safety cones from being released from said receptacle.

35. The method as set forth in claim 28, wherein said releasing means is an advancing system to advance said one of said plurality of safety cones while preventing the remainder of safety cones from being released from said receptacle.

36. The method as set forth in claim 28, wherein said releasing means comprises one or more elements wherein said one or more elements are arranged in a pattern and attached to a common structure, wherein said common structure is movably attached to said receptacle.

37. The method as set forth in claim 28, wherein said releasing means comprises one or more elements and wherein said one or more elements comprises propeller-like elements.

38. The method as set forth in claim 28, wherein said releasing means comprises a spiral element capable of holding said plurality of safety cones, and capable of releasing said one of said plurality of safety cones when said spiral element advances rotationally around its longitudinal axis.

39. The method as set forth in claim 28, wherein said control means controls the timing of said release of said one of said plurality of safety cones.

40. The method as set forth in claim 28, wherein said control means controls the timing between the release of two or more safety cones from said plurality of safety cones, wherein said two or more safety cones are released sequentially and placed at different positions on said ground surface.

41. The method as set forth in claim 28, wherein said control means comprises the step of providing one or more sensors to provide feedback to said control means, wherein said sensors provide information regarding speed of said vehicle, distance traveled by said vehicle, said time lapsed between safety cone releases, or correct placement or release of said safety cone.

42. The method as set forth in claim 28, wherein said control means comprises the step of determining when to release the next safety cone.

43. The method as set forth in claim 28, wherein said control means comprises the step of providing a voice recognition system to receive voice commands from a user and said one or more voice commands control said releasing means.

44. The method as set forth in claim 28, wherein said control means comprises the step of providing a touch-panel to allow a user to enter one or more commands to control said releasing means.

45. The method as set forth in claim 28, wherein said control means comprises the step of providing one or more switches or buttons to allow a user to control said releasing means.

46. The method as set forth in claim 28, wherein said control means comprises the step of providing a programmable user interface to program one or more control parameters that control said releasing means.

47. The method as set forth in claim 28, wherein said control means comprises the step of providing one or more schedules to schedule the release of said safety cones.

48. The method as set forth in claim 28, wherein said control means comprises the step of providing a wireless communication to communicate with said releasing means.

49. The method as set forth in claim 28, wherein each of said plurality of safety cones comprises a flexible cone part positioned over a base wherein the bottom of said flexible cone part is attached to said base.

50. The method as set forth in claim 28, wherein each of said plurality of safety cones comprises a flexible means positioned over a base wherein the bottom of said flexible means is attached to said base.

51. The method as set forth in claim 28, wherein each of said plurality of safety cones comprises a flexible means positioned over a base, wherein the bottom of said flexible means is attached to said base, and wherein said flexible means comprises a light source that could be activated upon release and placement of said one of plurality of safety cones to a position on a ground surface.

52. The method as set forth in claim 28, further comprising the step of stacking said plurality of safety cones on top of each other.

53. The method as set forth in claim 28, wherein said receptacle comprises an opening through which said one of said plurality of safety cones are released.

54. The method as set forth in claim 28, wherein said receptacle comprises an opening means to create an opening through which said one of said plurality of safety cones could be released.

55. The method as set forth in claim 28, wherein said receptacle comprises guiding means to guide said plurality of safety cones.

56. A system for automatically delivering and placing safety cones from a moving vehicle, comprising:

(a) a plurality of safety cones each of which is capable of undergoing natural and traffic perturbations and of staying upright and stable in absence of said perturbations:

(b) receptacle for holding said plurality of safety cones, wherein said receptacle is attached to said moving vehicle;

(c) a releasing means coupled to said receptacle for releasing one of said plurality of safety cones, one at a time, from said receptacle directly to a position on a ground surface and for preventing the remainder of said plurality of safety cones from being released from said receptacle; and (d) a control means coupled to said releasing means for controlling said releasing means such that said plurality of safety cones are released and placed at different positions on said ground surface.

57. A system for automatically delivering and placing safety cones from a moving vehicle, comprising:

(a) a plurality of safety cones, wherein each of said plurality of safety cones comprises a base, a flexible means positioned over said base, and a cover covering said flexible means, wherein said base has an opening for stacking and is attached to the bottom of said flexible means, and wherein each of said plurality of safety cones is capable of undergoing natural and traffic perturbations and of staying upright and stable in absence of said perturbations;

(b) a receptacle attached to said moving vehicle for holding said plurality of safety cones:

(c) releasing means coupled to said receptacle for releasing one of said plurality of safety cones, one at a time, from said receptacle directly to a position on a ground surface and for preventing the remainder of said plurality of safety cones from being released from said receptacle; and (d) a control means coupled to said releasing means for controlling said releasing means such that said plurality of safety cones are released and placed at different positions on said ground surface.

* * * * *